US005234121A

United States Patent [19]

Chen

[11] Patent Number: 5,234,121

[45] Date of Patent: Aug. 10, 1993

[54] TELESCOPING CONTAINERS

[76] Inventor: Win H. Chen, 3F No. 46, Min Chuan Rd., Sin Tien City Taipei Shian, Taiwan

[21] Appl. No.: 980,256

[22] Filed: Nov. 23, 1992

[51] Int. Cl.[5] ..... B65D 6/26

[52] U.S. Cl. ..... 220/8; 220/326

[58] Field of Search ..... 220/8, 326, 306, 666

[56] References Cited

U.S. PATENT DOCUMENTS

| | | | |
|---|---|---|---|
| 752,159 | 2/1904 | Hamilton | 220/8 |
| 1,707,841 | 4/1929 | Broadfoot | 220/8 |
| 3,539,070 | 11/1970 | Dunlea, Jr. | 220/8 |
| 4,724,976 | 2/1988 | Lee | 220/8 |

*Primary Examiner*—Allan N. Shoap
*Assistant Examiner*—Paul A. Schwarz
*Attorney, Agent, or Firm*—Donald A. Kaul

[57] ABSTRACT

A telescoping container has an inner section which is telescopically movable into and out of an outer section and has biasing means formed integrally with the sections to normally bias said sections to an untelescoped position. When pressure is applied to said sections, the biasing means yields to permit the sections to move to a telescoped position. The biasing means comprises biasing elements integrally formed on one section aligned with and engaging the biasing elements integrally formed on the other section. Coupling means are provided to prevent the sections from becoming detached from one another.

8 Claims, 1 Drawing Sheet

TELESCOPING CONTAINERS

This invention relates to an improvement in telescoping containers of the type which may advantageously contain a pressure activated device which is actuated when the sections of the container are telescoped together.

In particular, this invention finds utility in pressure activated sound devices such as are employed in toys or novelty items. In such devices, the pressure activated means or member is housed within a container having a pair of nested or telescoped sections which can be squeezed together to thereby actuate the pressure means. When actuated, the pressure means may complete a circuit which causes a prerecorded sound to be emitted from the container.

Telescoping containers of this type have been used for some time and are well-known in the prior art. Such containers include a pair of sections forming an inner and an outer section, each having a base wall and surrounding sidewalls. The containers sections are of a telescoping or nesting type; that is, the inner section fits within the outer section so that the sidewall of the outer section surrounds the sidewall of the inner section. Some form of coupling means is provided to assure that the sections do not become disconnected from each other, thereby securing the contents of the container, which includes the pressure activated member and other items such as electronics and batteries.

It has long been recognized that the only way in which such known containers will satisfy their intended function is for a biasing means to be included within the container to bias or urge the sections apart from each other to an untelescoped position. The need for such a biasing member becomes apparent when it is recalled that the pressure activated means is actuated when the container sections are moved to their telescoped position. Therefore, biasing means have been employed to maintain the sections in their untelescoped position; however, such biasing means was easily overcome by an application of pressure to enable the sections to move to their telescoped position and thereby actuate the pressure activated sound device or other device in the container.

In the prior art arrangements of this type, the biasing means has been provided by incorporating compression springs within the container to abut against the container sections and thereby force them apart. While this arrangement has generally operated satisfactorily, it has been a difficult and time-consuming task to correctly insert and position the biasing springs at the time the container sections are being finally assembled with each other. Also, the cost of providing separate compression springs has increased the unit cost for a telescoping container assembly employing such springs as the biasing means.

With the foregoing in mind, it is therefore an object of the present invention to provide an improvement in such known forms of telescoping containers by forming the biasing means integrally with the container itself and thereby doing away with the need for separate compression springs.

Another object of the present invention is to provide an improved form of telescoping container which incorporates its own biasing means and is thereby less expensive and time-consuming to produce and assemble.

Another object of the present invention is to provide an improved form of telescoping container wherein the inner and outer sections will automatically be biased apart when the sections are assembled.

Other objects, advantages, and salient features of the present invention will become apparent from the following detailed description, which, taken in conjunction with the annexed drawings, discloses a preferred embodiment thereof.

Referring to the drawings.

Figure 1:
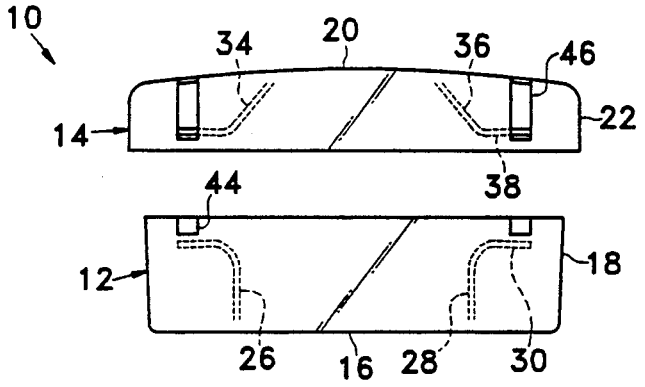
FIG. 1 is a side elevational view of the improved container of the present invention with the sections being disassembled for illustrative purposes only.

Referring now to the drawings in further detail, the container of the present invention is generally designated 10. It consists of an inner section generally designated 12 and an outer section generally designated 14.

The inner section 12 is formed by a main wall 16, which forms the base of the container 10, and a surrounding upstanding sidewall 18 formed integrally with the main wall 16. The outer section 14 also includes a main wall 20, which forms the top of the container, and a surrounding depending sidewall 22 formed integrally with the main wall 20.

The relative sizes of the inner and outer sections 12 and 14 are selected so the inner section 12 fits within the outer section 14, with the sidewall 22 of the outer section circumscribing and surrounding the sidewall 18 of the inner section. While the fit is relatively snug, there is still enough play between the sections to enable the inner section 12 to move freely into and out of the outer section 14.

Figure 2:
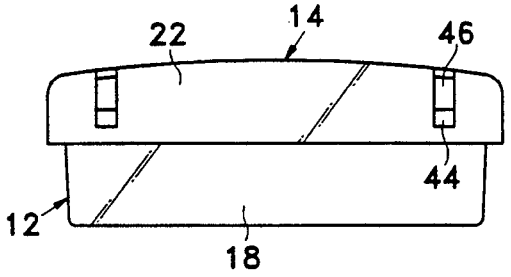
FIG. 2 is a side elevational view showing the improved container of the present invention in the untelescoped position.
Figure 4:
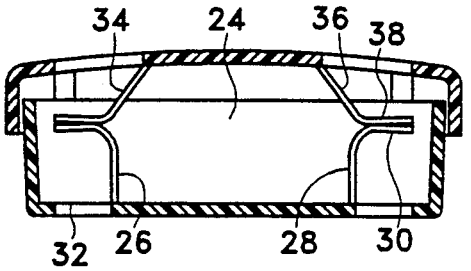
FIGS. 4 and 5 are sectional views showing the container of the present invention in the untelescoped and telescoped positions, respectively.

As can be seen, when the sections are assembled, as shown in FIGS. 2–5, there is an internal chamber or cavity 24 formed within the container 10. The size of that internal chamber or cavity 24 varies, depending upon whether the container is in telescoped or untelescoped position. In FIGS. 2 and 4, the container is in its normal or untelescoped position and the chamber or cavity 24 is of a large size equal to most of the internal volume of the sections 12 and 14. However, when the container is in the telescoped position of FIGS. 3 and 5, the size of the internal chamber or cavity 24 is much smaller, and is generally the volume of the inner section 12 plus a small portion of the volume of the outer section 14.

The biasing means of the present invention is intended to normally maintain the sections in their untelescoped position as shown in FIGS. 2 and 4. The biasing means includes biasing elements formed integrally with each of the sections. The biasing elements 26 of the inner section 12 include a first portion 28 which is substantially perpendicular to the main wall 16 and a second portion 30 extending freely from the upper end of the first portion 28. The second portion 30 is disposed in substantially parallel relation to the main wall 16. The lower end of the first portion 28 is integrally connected to the main wall 16 and an aperture 32 is formed in the main wall 16 adjacent to each first portion 28 and underlying each second portion 30. As can be seen, there are four apertures 32 near the four corners of the inner section 12 and a biasing element 26 is adjacent to each of those apertures.

The biasing elements 34 of the outer section 14 include a first portion 36 which is disposed at an acute angle to the main wall 20 and a second portion 38 extending freely from the upper end of the first portion 36. The second portion 38 is disposed in substantially parallel relation to the main wall 20. The lower end of the first portion 36 is integrally connected to the main wall 20 and an aperture 40 is formed in the main wall 20 adjacent each first portion 36 and underlying each second portion 38. As can be seen, there are four apertures 40 near the four corners of the outer section 14 and a biasing element 28 is adjacent to each of those apertures.

The biasing elements 26 of the inner section 12 align beneath the biasing elements 34 of the outer section 14, such that the second portions of those elements, namely, the portions 30 and 38 respectively, abut against each other when the sections are assembled together.

Figure 3:
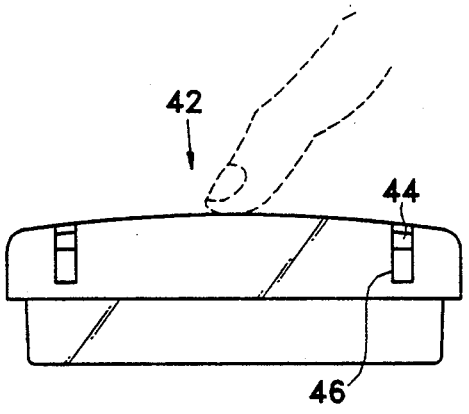
FIG. 3 is a side elevational view, similar to FIG. 2, showing the improved container of the present invention in the telescoped position.
Figure 5:
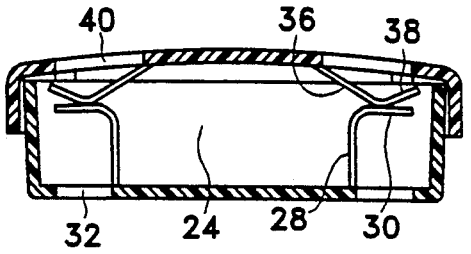

The entire container 10 is advantageously fabricated of plastic material having a sufficient degree of flexibility such that the cooperating biasing elements 26 and 34 act as spring fingers. That is, under normal circumstances, the engagement of the biasing elements 26 of the inner section against the biasing elements 34 of the outer section serve to maintain the sections in untelescoped position, as shown in FIGS. 2 and 4. However, when pressure is applied, as shown in FIG. 3 where digital pressure is being applied in the direction of the arrow 42, the biasing effect of the elements can be overcome. In this situation, the biasing elements 34 of the outer section are deformed toward the main wall 20 thereof, as shown in FIG. 5, and the container sections assume their telescoped position of FIGS. 3 and 5. The angular disposition of the elements 34 makes them deform more readily than the upright position of the elements 26.

As noted above, coupling means must be provided to assure that the sections remain assembled. The coupling means also serve to limit the range of telescoping motion of the sections relative to one another. The coupling means is provided by projections 44 along the exterior of the sidewall 18 of the inner section 12 which fit into and slide within slots 46 along the sidewall 22 of the outer section 14. As shown in FIG. 2, when the container is in its normal or untelescoped position, the sections are biased apart until the projections 44 engage against the bottom of the slots 46. As shown in FIG. 3, when the container is in its telescoped position, the biasing effect of the biasing elements is overcome, and the sections are telescopically nested, until the projections 44 engage against the top of the slots 46.

It will be understood that a pressure activated device may be placed within the container chamber or cavity 24 and that a projection may be carried on the underside of the outer section main wall 20 such that, when the container is telescoped to the position of FIGS., 3 and 5, the projection will engage against and apply pressure to the device to actuate the same. These elements have not been illustrated since they are known in the art and do not form any part of the present invention. It will also be understood that additional apertures or openings may be included in the main wall 20 to facilitate, for example, the transmission of sound from a prerecorded sound device with the chamber or cavity 24.

It will be apparent to those skilled in the art that various changes may be made in the details of the improvement described herein without departing from the spirit and scope of the invention as defined in the appended claims.

What is claimed is:

1. In a telescoping container of the type wherein a container inner section is telescopically movable into and out of a container outer section, wherein a biasing means normally urges said sections to an untelescoped position, and wherein a coupling means prevents said sections from becoming detached from each other, the improvement which comprises:

said biasing means including biasing elements formed integrally with each of said sections;

the biasing elements on said inner section being aligned with and abutting against the corresponding biasing elements on said outer section;

said biasing elements being flexible enough to yield when pressure is applied to said sections to cause said inner section to move telescopically into said outer section;

said biasing elements being strong enough to force said sections to the untelescoped position when the pressure on said sections is released.

2. The improvement defined in claim 1 wherein said sections each include a main wall and a surrounding sidewall and wherein said biasing elements are formed integrally with said main walls.

3. The improvement defined in claim 2 wherein said biasing elements each include a first portion, one end of which is integrally connected with said main wall, and a second portion extending freely from the opposite end of said first portion.

4. The improvement defined in claim 3 wherein said second portions of said biasing elements are disposed in spaced substantially parallel relation to said main walls.

5. The improvement defined in claim 4 wherein said first portion of the biasing elements on one section is substantially perpendicular to said main wall thereof and wherein said first portion of the biasing elements on said other section is disposed at an acute angle to said main wall thereof.

6. The improvement defined in claim 3 wherein aperture means are provided in said main walls adjacent to said first portions and beneath said second portions.

7. The improvement defined in claim 6 wherein said main walls and said biasing elements are integrally fabricated of flexible plastic material.

8. The improvement defined in claim 7 said coupling means are provided along said sidewalls and are formed by projections from the sidewall on one section which slidably interfit with elongated slots on the sidewall of the other section.

* * * * *